US008907808B2

(12) United States Patent
Cienfuegos

(10) Patent No.: US 8,907,808 B2
(45) Date of Patent: Dec. 9, 2014

(54) LIGHTING OPERATION SEQUENCE SYSTEM AND METHOD(S) FOR VISUALLY IDENTIFYING, DISTINGUISHING, AND TRACKING DISASTER VICTIMS

(76) Inventor: Juan Cienfuegos, San Antonio, TX (US)

( * ) Notice: Subject to any disclaimer, the term of this patent is extended or adjusted under 35 U.S.C. 154(b) by 215 days.

(21) Appl. No.: 13/466,203

(22) Filed: May 8, 2012

(65) Prior Publication Data

US 2012/0286952 A1 Nov. 15, 2012

Related U.S. Application Data

(60) Provisional application No. 61/518,641, filed on May 9, 2011.

(51) Int. Cl.
*G08B 21/00* (2006.01)
*G08B 5/00* (2006.01)

(52) U.S. Cl.
CPC ..... *G08B 5/002* (2013.01)
USPC ..... 340/815.4; 340/815.45; 340/539.13; 340/691.3

(58) Field of Classification Search
CPC ..... G08B 1/08
USPC ..... 340/573.1, 539.1, 539.13, 691.2, 691.3, 340/815.4, 815.45, 332
See application file for complete search history.

(56) References Cited

U.S. PATENT DOCUMENTS

| | | | | |
|---|---|---|---|---|
| 5,977,913 | A | 11/1999 | Christ | |
| 6,114,948 | A * | 9/2000 | Astell | 340/332 |
| 6,558,082 | B1 | 5/2003 | Courtney et al. | |
| 7,023,004 | B2 | 4/2006 | Ford | |
| 7,315,036 | B2 | 1/2008 | Ford | |
| 7,510,527 | B1 | 3/2009 | Cienfuegos | |
| 7,637,226 | B1 | 12/2009 | Bradley | |
| 7,640,003 | B1 | 12/2009 | Pan | |
| 7,674,227 | B1 | 3/2010 | Cienfuegos | |
| 7,839,290 | B2 | 11/2010 | Chidakel et al. | |
| 7,859,418 | B2 | 12/2010 | Greene | |
| 2005/0087702 | A1 * | 4/2005 | Ford et al. | 250/504 R |

* cited by examiner

*Primary Examiner* — Jeffery Hofsass
(74) *Attorney, Agent, or Firm* — Rafael V. Baca; Baca Law Firm, PLLC

(57) ABSTRACT

A method of locating, tracking, distinguishing and identifying people and pets as survivors or non survivors in the aftermath of a natural or manmade disaster, the method includes the use of illuminated displays such as flashlights, illuminated beacons, smart phone screens and/or computer screens. In one exemplary method, the illuminated displays are set to a particular color and flash pattern to distinguish between men, women, children, pets and whether they survived or not. When an alert is issued people prepare as they normally do but add one step: Tag or equip themselves and others with the illuminated displays set to the appropriate setting so that responders can utilize the night to locate the illuminate displays now recognized as indicators of people so they can better plan first light rescue operations.

20 Claims, 3 Drawing Sheets

Rotate to select steady on, flashing on, off

Press switch several times to activate the desired mode or color

LIGHTING OPERATION SEQUENCE SYSTEM AND METHOD(S) FOR VISUALLY IDENTIFYING, DISTINGUISHING, AND TRACKING DISASTER VICTIMS

This application is a continuation of provisional patent application No. 61/518,641, filed May 9, 2011

FIELD OF THE INVENTION

This invention relates to a method for identifying survivors by utilizing illuminated displays. These illuminated displays are attached toe or held by each person prior to a disaster striking. For example soon after an emergency tornado alert is sounded by the local authorities. The idea is to utilize the night to locate people who remained in the disaster affected area by searching for the illuminated displays that are attached toe or held by each person or pet.

BACKGROUND OF INVENTION

The object of the present invention is to provide for a new method of identifying survivors and non survivors. The illuminated displays are used to convey the location and status of each user in the aftermath of a natural disaster such as a tsunami, tornado, flood, hurricane etc. . . .

Today there is a need for a system that will utilize the night to help locate survivors and non survivors in the aftermath of a disaster. Currently most search and rescue operations stop at night and people located in the disaster stricken area must wait for the day to start signaling their location and survival status in hopes of getting noticed. With the technology of the present Application having an illuminated display system having an illuminated display, the illuminated display system provides at least one method for identifying disaster survivors. Accordingly, these methods for identifying disaster survivors capitalize on the notion that there is no reason why we should not use the 12 dark hours of the 24 hour day to continue some form of search and rescue. Generally, this can be done in part by utilizing the smart phones or computer screens that most of us carry with us every day. Ideally products like the Emergency/Triage Lights which are more durable and last much longer having different colored LED's having different visible wavelengths such as white, red, yellow, green and/or blue would be utilized.

Notice every disaster scene that is seen on television remains constant, the images of the people on rooftops, car tops and trees waving trying to convey their location and the fact that they survived and are in need of help.

With the above image in mind I have developed the following method for Emergency/Triage Lights and other illuminated displays such as flashlights with colored filters, flashlights with multiple colored LED's, beacons with multiple colored lights, single colored lights, smart phone screens and/or computer screens to now empower populations to help first responders help those populations during a disaster that are in need of assistance. Specifically, the present Application provides at least in part a method of visually locating, tracking, distinguishing and triaging the locations of disaster site victims and casualties by utilizing lights and the night time hours to do so.

SUMMARY OF THE INVENTION

The method of utilizing an illuminated display to locate and identify people or pets in the aftermath of disaster is implemented in the following exemplary manner, among others. First, an alert is issued by a Local, State or Federal agency indicating a disaster is approaching or has occurred. For example a hurricane warning, a tsunami warning, a tornado warning, etc. . . . The population found in the area that is effected then starts to prepare for the oncoming devastation with the forewarned disaster to arrive. Unlike other known methods, the present invention provides for part of that preparation by equipping or attaching an illuminated display to each member of the family. In at least one aspect of the present invention, children are identified by solid red light, women are identified by solid green light, men are identified by solid blue light and pets are identified by yellow light. This is done before the disaster strikes, such as hours, minutes or seconds before. Once the disaster has passed and the person wearing or utilizing the illuminated display has survived, the living then change their illuminated solid color to a flashing color to indicate they are survivors and in need of help. In at least one aspect, non survivors would be identified by the illuminated displays that have not been changed to a flashing selection. In at least one aspect the people who did survive and are not able to change the color selection from a solid to a flashing could move the illuminated display to show movement and therefore signal they are in need of assistance and are alive.

In at least one illustration, under the present method, first responders now can identify surviving children by the flashing red illuminated displays, surviving women by the flashing green illuminated displays, surviving men by the flashing blue illuminated displays and pets by the solid or flashing yellow lights. The present method now allows search and rescue for the night and the darkness to be utilized to aid first responders in locating and identifying non survivors and survivors for up to 2 weeks, for example. Now, under the present method, the 12 hours of the day that are generally dark and not fully utilized in the absence of the present invention are used to gather intelligence as to where people are located, the makeup of each group located. Moreover, under the present method, the condition of each group or individual located and are now able to preplan first light rescue operations accordingly.

BRIEF DESCRIPTION OF THE DRAWING

FIG. 3 are orthographic views from the top illustrating one exemplary embodiment of an illuminated display system, in particular.

DETAILED DESCRIPTION

Figure 1:
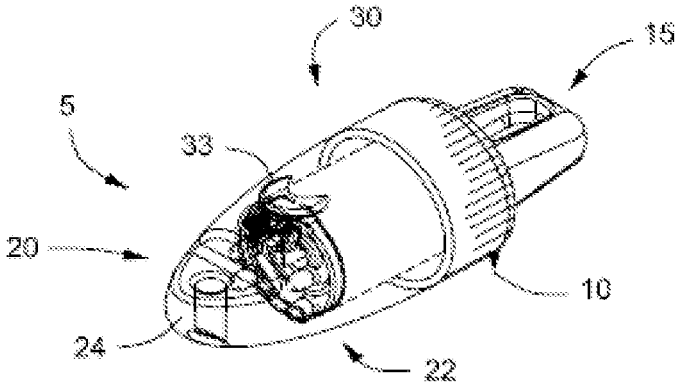
FIG. 1 is an isometric view from the top illustrating an illuminated display system for placement on an user according to the present invention, the illuminated display system includes a plurality of light emitters that individually emit a predetermined wavelength band relating to the users identity (child, woman, man, pet for example) and condition (survivor, non survivor for example)
Figure 2:
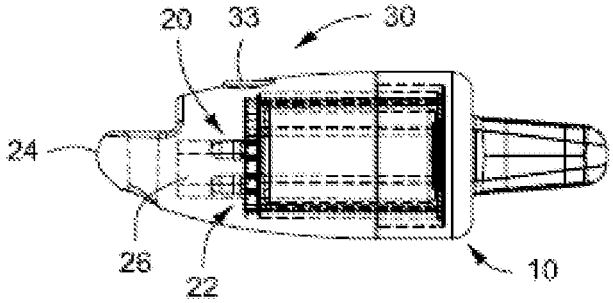
FIG. 2 is an orthographic view from the side illustrating one exemplary embodiment of an illuminated display system.
Figure 3A:
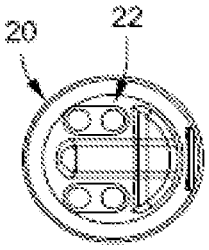
FIG. 3*a* is an orthographic view from the front illustrating a display interface of the illuminated display system.
Figure 3B:
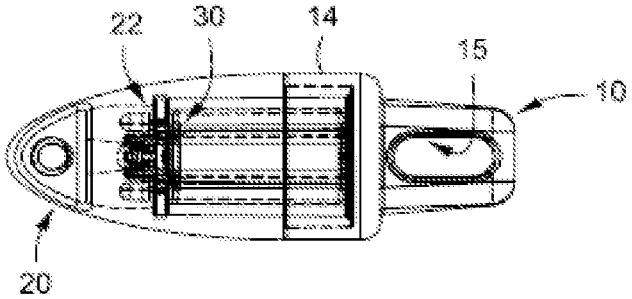
FIG. 3*b* is an orthographic view from the top illustrating an illuminated display system having a fastening interface

Referring to FIG. 1-3, there is shown an illuminated display system 30 for placement on a user according to the present invention. The illuminated display system incorporates four LED's 22, each LED 22 emitting a different wavelength of light, each wavelength of light conveying a different meaning. In at least one illustrative method provided by the present invention, the illuminated display system 30 illuminating the solid red selection indicates a child pre disaster. A flashing red selection indicates a surviving child post disaster. In at least one illustrative method provided by the present invention, the illuminated display system 30 illuminating a solid green selection indicates a woman pre-disaster. A flashing green indicates a surviving woman post disaster. Illuminating solid blue selection indicates a male pre-disaster. A flashing blue indicates a surviving male post disaster. The yellow is an optional selection embodiment and in this embodiment of the invention is used to tag a pet. It would be up to the animal owner to switch the selection on the illuminated display system 30 to flashing to indicate the pet has survived. The yellow may originally be set to flash to increase the longevity of the battery. In at least one exemplary embodiment, the flash rate to identify a survivor is in the range between 50 and 70 pulses per minute. Moreover, one exemplary embodiment of an illuminated display of an illuminated display system 30 includes a lock feature that prevents the illuminated display from being inadvertently switched or turned off.

Figure 4:
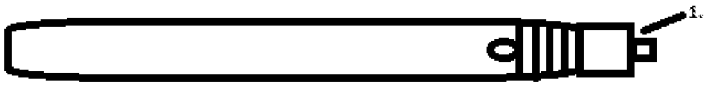
FIG. 4 is a drawing of a single colored, multimode illuminated device using a rotary switch to select the appropriate mode provided by at least one method of the present invention of steady continuous light or flashing light.

Referring to FIG. 4 there is shown an illuminated display system 30 having illuminated single colored, multimode (steady/flash) light 22 for placement on a user or to be held by the user according to the present invention. The illuminated single colored, multi-mode light can be activated by rotating a switch 1 to the solid on selection and rotating it further to the flashing selection.

Figure 5:
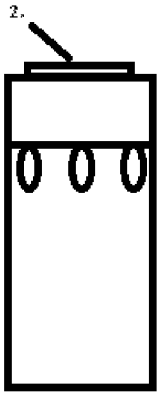
FIG. 5 is a drawing of a single colored, multimode illuminated device using a pushbutton switch to select the appropriate mode provided by at least one method of the present invention of steady continuous light or flashing light.

Referring to FIG. 5 there is shown an illuminated display system 30 having a single colored, multimode light for placement on a user according to the present invention. Illustratively, the illuminated display is attached to the person by being held in the hand. The illuminated single colored, multimode light is activated by pressing a switch 2 to get to the desired mode selection, off, on, flashing, etc. . . .

The illuminated, single colored, multimode light may also contain whistles, mirrors and other signaling methods attached or designed into the illuminated display. In one exemplary embodiment, the illuminated display is water resistant and/or waterproof.

Figure 6:
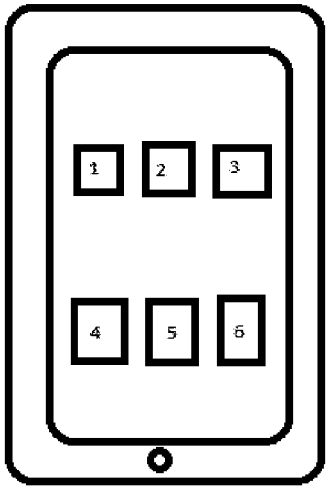
FIG. 6 is a drawing of a mobile device screen utilizing an application to implement the illuminated display personal disaster identification method by changing the screen color to the appropriate color and mode provided by at least one method of the present invention for the circumstance.

Referring to FIG. 6 there is shown a mobile device utilizing a mobile application to utilize the method in case there is no time to go home and prepare. In at least one exemplary embodiment, the illuminated display is a smart phone or computer screen. Accordingly, mobile device user selects the application and is given the choice of selecting 1. Pre-disaster child (red), 2. pre-disaster woman (green), 3. pre-disaster man (blue), 4. Post disaster child (flashing red), 5. post disaster woman (flashing green) and 6. post disaster man (flashing blue). Once selected by the mobile device user, the mobile device displays the corresponding illuminated screen color and flash setting. The mobile device if capable would also send out a wifi, rfid, blue tooth or smart Bluetooth signal to further aid in pinpointing the location of the user utilizing the illuminated display from that user's mobile device. In fact, the mobile device could send the particular mobile device user's GPS location to selected friends when the mobile application is activated and thus not only giving the user a signaling device but has sent out his locations when the mobile application is activated or updated.

Figure 7:
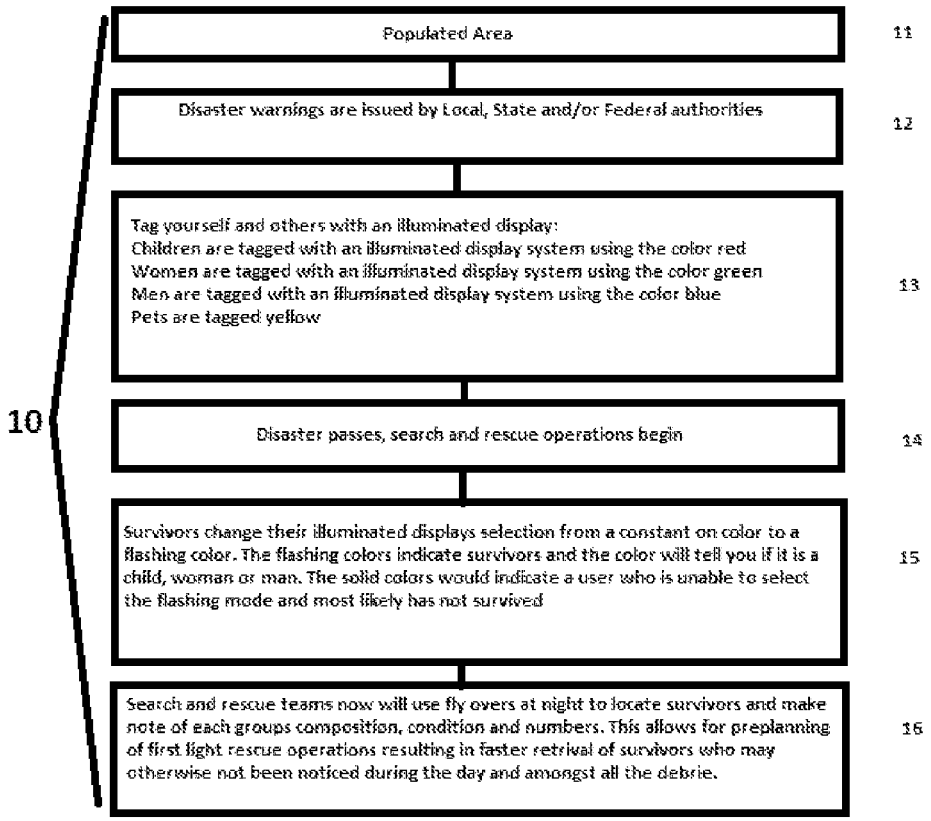
FIG. 7 is a diagram one illustrative embodiment of the personal disaster identification method

Referring at least to FIG. 7, one exemplary embodiment of a method 10 for visually locating and tracking disaster site victims may be appreciated as follows. You begin with a population 11 that is soon to be struck by a disaster. Disaster warnings 12 are issued and the population 11 gets prepared. Part of that preparation includes the tagging or equipping of each family member with an illuminated display 13. Children are equipped or tagged solid red illuminated displays prior to the disaster arriving. Women are equipped or tagged solid green illuminated displays prior to the disaster arriving. Men are equipped or tagged solid blue illuminated displays prior to a disaster arriving and pets are tagged yellow illuminated displays. Illustratively, in one exemplary embodiment, the lighting operation sequence includes the step of identifying pre-disaster children with a red illuminated display, and pre-disaster women with green illuminated display, and pre-disaster men with a blue illuminated display. In an alternative embodiment, the lighting operation sequence includes the step of identifying post disaster survivor children with flashing red illuminated displays, post disaster survivor women with a flashing green illuminated display and post disaster survivor man with a flashing blue illuminated display. Optionally, in an alternative embodiment, the lighting operation sequence includes the step of identifying pets with a yellow illuminated display.

Once the disaster has passed 14, the survivors switch 15 their illuminated displays to a flashing selection. By switching 15 to the flashing selection the illuminated display user has accomplished two things. First the battery life is now extended and will allow the illuminated displays to illuminate brighter and longer. Second it will allow first responders to distinguish between non survivors and survivors thus allowing them to focus search and rescue efforts on the living (flashing) and at the same time flag or mark where non flashing illuminated displays are located. In at least one aspect the people who did survive and are not able to change the color selection from solid to flashing could move the illuminated display to show movement and therefore signal they are in need of assistance and are alive. In one exemplary embodiment, the illuminated display includes a memory recall and return to the selected color even after power has been lost to the illuminated display system due to adverse conditions found during a disaster. First responders can now utilize the illuminated displays to gather intelligence and better preplan 16 first light rescue operations thus reducing the time and costs associated with these endeavors, besides increasing the efficiency of the Search and Rescue teams.

Although the present invention has been described in detail, it should be understood that various changes, substitutions, and alterations could be made hereto without departing from the spirit and scope of the invention as defined by the appended claims.

The invention claimed is:

1. A method for visually identifying, distinguishing, and tracking a plurality of disaster user victims comprising the steps of:

providing an illuminated display system, the illuminated display system including an illuminated display and a processor communicatively connected to the illuminated display, the illuminated display providing different wavelengths of light by emissions controlled by the processor therefrom, each respective wavelength of light providing information relating to a corresponding status of each disaster user victim;

assigning an illuminated display to each disaster user victim of the plurality of disaster user victims;

providing a lighting operation sequence, the lighting operation sequence comprises an application function executed by the processor for emitting wavelengths of light from the illuminated display;

issuing a trigger, the trigger engages the lighting operation sequence for each illuminated display assigned to a corresponding disaster user victim of the plurality of disaster user victims;

identifying, via the lighting operation sequence, disaster user victims from emissions of predetermined wavelengths of light that correspond to men, women, and children;

distinguishing, via the lighting operation sequence, disaster user victims from emissions of predetermined wavelengths of light that correspond to alive or deceased status; and tracking, via the lighting operation sequence, user victims over a predetermined period by which corresponding predetermined wavelengths of light are emitted.

2. The method according to claim 1 wherein the step of identifying disaster user victims from emissions of predetermined wavelengths of light that correspond to men, women, and children further includes the step of assigning a predetermined blue wavelength of light to correspond to men, a predetermined green wavelength of light to correspond to women, and a predetermined red wavelength of light to correspond to children.

3. The method according to claim 1 further comprising the step of identifying disaster user victims from emissions of predetermined wavelengths of light that correspond to animals.

4. The method according to claim 1 wherein the step of identifying disaster user victims from emissions of predetermined wavelengths of light that correspond to animals further includes the step of assigning a predetermined yellow wavelength of light to correspond to animals.

5. The method according to claim 1 wherein the trigger comprises issuing a pre-disaster warning.

6. The method according to claim 5 wherein the step of tracking a plurality of disaster user victims further includes the step of continuously emitting at least one light wavelength from each illuminated display before a disaster strikes.

7. The method according to claim 5 wherein the step of tracking a plurality of disaster user victims further includes the step of intermittently emitting at least one light wavelength from each illuminated display after a disaster strikes.

8. The method according to claim 1 wherein the trigger comprises issuing a post-disaster warning.

9. The method according to claim 1 wherein the illuminated display further includes a switch, the switch coupled to the illuminated display.

10. The method according to claim 9 wherein the lighting operation sequence further includes the step of a disaster user victim toggling between injured and non-injured via the switch.

11. The method according to claim 9 wherein the lighting operation sequence further includes the step of one disaster user victim assigning corresponding illumination status of either man, woman or child via the switch.

12. A system for visually identifying, distinguishing, and tracking a plurality of disaster user victims, comprising:

an illuminated display system, the illuminated display system including an illuminated display and a processor communicatively connected to the illuminated display, the illuminated display coupled to each disaster user victim of the plurality of disaster user victims, the illuminated display providing different wavelengths of light by emissions controlled by the processor therefrom, each respective wavelength of light providing information relating to a corresponding status of each disaster user victim;

a lighting operation sequence, the lighting operation sequence comprises an application function executed by the processor for emitting wavelengths of light from the illuminated display, the lighting operation sequence includes the step of identifying disaster user victims from emissions of predetermined wavelengths of light that correspond to men, women, and children, the further step of distinguishing disaster user victims from emissions of predetermined wavelengths of light that correspond to deceased, alive, and alive but injured, and the further step of tracking user victims over a predetermined period by which predetermined wavelengths of light are emitted; and a trigger, the trigger engages the lighting operation sequence for each illuminated display assigned to the plurality of disaster victims.

13. The system according to claim 12 wherein the step of identifying disaster user victims from emissions of predetermined wavelengths of light that correspond to men, women, and children includes the step of assigning a predetermined blue wavelength of light to correspond to men, a predetermined green wavelength of light to correspond to women, and a predetermined red wavelength of light to correspond to children.

14. The system according to claim 12 wherein the trigger comprises issuing a pre-disaster warning.

15. The system according to claim 14 wherein the step of tracking a plurality of disaster user victims further includes the step of continuously emitting at least one light wavelength from each illuminated display before a disaster strikes.

16. The system according to claim 14 wherein the step of tracking a plurality of disaster user victims further includes the step of intermittently emitting at least one light wavelength from each illuminated display after a disaster strikes.

17. The system according to claim 12 wherein the trigger comprises issuing a post-disaster warning.

18. The system according to claim 12 wherein the illuminated display further includes a switch, the switch coupled to the illuminated display.

19. A method for visually identifying, distinguishing, and tracking a plurality of disaster user victims comprising the steps of:

providing an illuminated display system, the illuminated display system including an illuminated display and a processor communicatively connected to the illuminated display, the illuminated display providing different wavelengths of light by emissions controlled by the processor therefrom, each respective wavelength of light providing information relating to a corresponding status of each disaster user victim;

assigning an illuminated display to each disaster user victim of the plurality of disaster user victims;

providing a lighting operation sequence, the lighting operation sequence comprises an application function executed by the processor for emitting wavelengths of light from the illuminated display;

issuing a trigger, the trigger engages the lighting operation sequence for each illuminated display assigned to the plurality of disaster victims;

identifying, via the lighting operation sequence, disaster user victims from emissions of predetermined wavelengths of light that correspond to men, women, and children;

distinguishing, via the lighting operation sequence, disaster user victims from emissions of predetermined wavelengths of light that correspond to deceased, alive, and alive but injured; and tracking, via the lighting operation sequence, user victims over a predetermined period by which predetermined wavelengths of light are emitted.

20. The method according to claim 19 wherein the illuminated display further includes a switch, the switch coupled to the illuminated display, and further comprising the step of toggling, via the disaster user victim, between injured and non-injured with the switch.

* * * * *